United States Patent [19]

Murakami et al.

[11] Patent Number: 4,908,765

[45] Date of Patent: Mar. 13, 1990

[54] AIR/FUEL RATIO CONTROLLER FOR ENGINE

[75] Inventors: Nobuaki Murakami; Osamu Hirako, both of Kyoto, Japan

[73] Assignee: Mitsubishi Jidosha Kogyo Kabushiki Kaisha, Tokyo, Japan

[21] Appl. No.: 125,618

[22] Filed: Nov. 25, 1987

[30] Foreign Application Priority Data

Nov. 29, 1986 [JP] Japan ..... 61-285202
Oct. 30, 1987 [JP] Japan ..... 62-275052

[51] Int. Cl.[4] ..... F02D 41/10

[52] U.S. Cl. ..... 364/431.05; 364/431.07; 123/492

[58] Field of Search ..... 364/431.05, 431.07, 364/431.10, 431.11; 123/486, 492, 489

[56] References Cited

U.S. PATENT DOCUMENTS

| | | | |
|---|---|---|---|
| 4,245,312 | 1/1981 | deVulpillieres | 364/431.07 |
| 4,401,080 | 8/1983 | Otsuka et al. | 123/440 |
| 4,469,073 | 9/1984 | Kobayashi et al. | 123/492 |
| 4,513,723 | 4/1985 | Ishikawa et al. | 123/486 |
| 4,665,878 | 5/1987 | Takeuchi et al. | 123/492 |
| 4,754,736 | 7/1988 | Yamato et al. | 364/431.07 |

OTHER PUBLICATIONS

JP-A-61 087 932 (Takeuchi et al.) (Mazda) (19-0-5-1987).

Pat. Abstracts of Japan, vol. 7, No. 133(M-221) [1278], 10th Jun. 1983; & JP-A-58 48 721 (Toyota Jidosha Kogyo K.K.) 22-03-1983.

Pat. Abstracts of Japan, vol. 6, No. 263(M-181) [1141], 22nd Dec. 1982; & JP-A-57 157 029 (Honda Giken Kogyo K.K.) 28-09-1982.

JP-A-61 237 848 (Nissan Motor) (23-10-1986) & Pat. Abstracts of Japan, vol. 11, No. 82 (M-571) [2529], 12th Mar. 1987.

Pat. Abstracts of Japan, vol. 9, No. 155(M-392) [1878], 29th Jun. 1985 & JP-A-60 30 443 (Toyota Jidosha K.K.) 16-02-1985.

Pat. Abstracts of Japan, vol. 8, No. 64(M-285) [1501], 27th Mar. 1984; & JP-A-58 214 649 (Toyoto Jidosha Kogyo K.K.) 213-12-1983.

*Primary Examiner*—Eugene R. LaRoche
*Assistant Examiner*—Seung Ham

[57] ABSTRACT

Disclosed herein is an air/fuel ratio controller for an engine, which is equipped with a function to make the air/fuel ratio leaner in a light-load operation zone or the like of a lean burn engine. The controller is intended to improve the starting performance and acceleration feeling of the engine significantly. Upon generation of an acceleration command by a driver during lean burn of the engine at a lean air/fuel ratio, an air/fuel ratio enriching device is operated to set the air/fuel ratio of an air-fuel mixture, which is to be fed to the engine, at a level richer than the lean air/fuel ratio while an actually accelerated state continues in the engine from the time point of generation of the acceleration command.

11 Claims, 9 Drawing Sheets

AIR/FUEL RATIO CONTROLLER FOR ENGINE

BACKGROUND OF THE INVENTION (1) Field of the Invention:

This invention relates in particular to an air/fuel ratio controller for an engine, which is equipped with a function to make the air/fuel ratio leaner in a light-load operation zone or the like of the engine.

(2) Description of Related Art:

As one method for improving the specific fuel consumption of an engine, it has been known to burn a lean air-fuel mixture. If the above burning method making use of such a lean air-fuel mixture is applied to a vehicle engine in particular, problems arise that no sufficient power is available upon acceleration in a lean burn period during which the engine power drops unavoidably and good vehicle drivability may not be assured. It has hence been proposed, for example, in Japanese Patent Laid-Open No. 87932/1986 to detect the operation zone of an engine so as to decide whether lean burn should be effected or not and also to detect an accelerated state of the engine so as to make the air/fuel ratio of an air-fuel mixture, which is to be fed to each combustion chamber of the engine, richer for ensuring sufficient engine power during the period of the accelerated state.

Upon detection of an acceleration, it is generally practised as indicated in the above patent publication to discriminate based on an acceleration command by an operator or driver (hereinafter called "driver" collectively) or the rate of a change of the opening rate of a throttle valve whether or not an engine is in an accelerated state or to discriminate based on the rate of a change of the pressure in an intake passage at a point downstream the throttle valve whether or not the engine is in an accelerated state. If the injection quantity of a fuel is increased for the sake of acceleration by the former method, namely, on the basis of the change rate of the throttle valve opening rate, the responsibility in an initial stage of the acceleration is good. The acceleration-related injection-quantity increment is however terminated at the time point of an end of the acceleration command (i.e., at the time point where the change rate of the throttle valve opening rate has reached approximately 0) and the air/fuel ratio is rendered leaner before the actually accelerated state of the engine is terminated (namely, the revolution number of the engine increases sufficiently), resulting in a drawback that the feeling of acceleration is reduced abruptly in a final stage of the actually accelerated state and satisfactory feeling. of driving cannot be obtained. If the injection quantity of a fuel is increased for the sake of acceleration by the latter method, namely, on the basis of the change rate of the pressure in the intake passage at the point downstream the throttle valve, the intake passage acts tentatively as an accumulator for the intake air in an initial stage of the acceleration and a delay takes place with respect to the pressure change. As a result, the initiation of an increment to the injection quantity of the fuel is delayed. As a consequence, the power increment of the engine fails to follow promptly an acceleration command by a driver, leading again to a drawback that no satisfactory feeling of driving is available.

SUMMARY OF THE INVENTION

The present invention has been completed with the foregoing in view.

In one aspect of this invention, there is provided an air/fuel ratio controller for an engine (14), said controller being equipped with an engine operation zone discriminating means (8,3) for discriminating a specific operation zone of the engine and a lean air/fuel ratio setting means for setting the air/fuel ratio of an air-fuel mixture, which is to be fed to the engine (14), at a level leaner than a stoichiometric air/fuel ratio upon receipt of an engine operation zone discriminating signal from said engine operation zone discriminating means, which comprises:

a means for detecting an acceleration command to the engine;

a means for detecting an actually accelerated state of the engine established responsive to the acceleration command;

an air/fuel ratio enriching means operable preferentially to said lean air/fuel ratio setting means so as to set the air/fuel ratio of the air-fuel mixture, which is to be fed to the engine, at a level richer than the air/fuel ratio leaner than the stoichiometric air/fuel ratio; and an air/fuel ratio enrichment control means for setting both starting time and ending time of an operation of said air/fuel ratio enriching means upon receipt of a signal from said acceleration command detecting means and another signal from said accelerated state detecting means, whereby the air/fuel ratio of the air-fuel mixture to be fed to the engine is set at a level richer than the air/fuel ratio leaner than the stoichiometric air/fuel ratio owing to an operation of said air/fuel ratio enriching means while the actually accelerated state continues in the engine from the time point of generation of the acceleration command.

In another aspect of this invention, there is also provided an air/fuel ratio controller for an engine (14), said controller being equipped with a means (8,3) for detecting the state of load of the engine and a lean air/fuel ratio setting means for setting the air/fuel ratio of an air-fuel mixture, which is to be fed to the engine (14), at a level leaner than a stoichiometric air/fuel ratio upon receipt of a signal from said engine load state detecting means in an operation state of a load level not higher than a predetermined load level, which comprises:

a means for detecting an acceleration command to the engine;

a means for detecting an actually accelerated state of the engine established responsive to the acceleration command; and a load level changing means for changing an upper limit of operable load levels for said lean air/fuel ratio setting means to a second load level (L3) lower than the predetermined load level upon receipt of a signal from said acceleration command detecting means and another signal from said accelerated state detecting means, whereby the upper limit of operable load levels of said lean air/fuel ratio setting means is maintained at the second load level (L3) by an actuation of said load level changing means while an actually accelerated state continues in the engine from the time point of generation of the acceleration command.

According to the present invention, upon generation of an acceleration command by a driver during lean burn, the driver's acceleration command and the actual state of acceleration of the engine are both detected and an air/fuel ratio enriching period is then set on the basis of results of the detection. It is hence possible to improve significantly the starting performance and the feeling of acceleration of a lean burn engine.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENT

One embodiment of this invention will hereinafter be described in detail with reference to the accompanying drawings.

Figure 1:
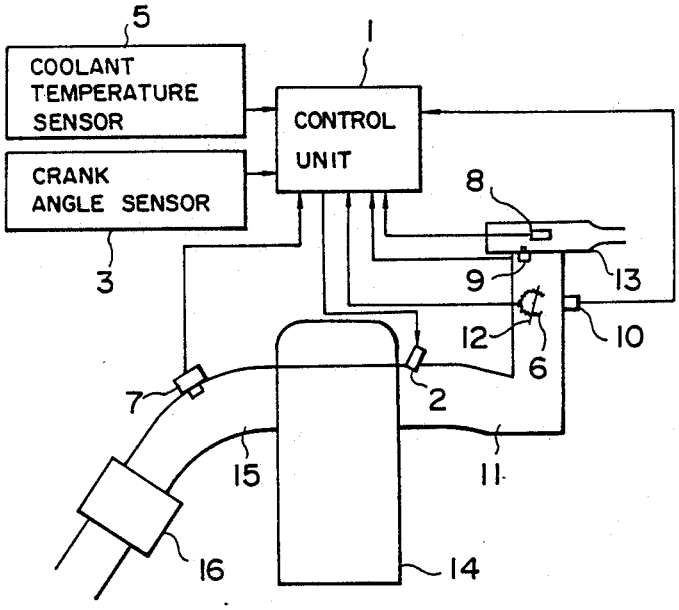
FIG. 1 is a schematic illustration showing the overall construction of a controller according to one embodiment of this invention along with an engine to which the controller has been applied.

Referring first to FIG. 1, an air cleaner 13 is provided at an upstream end of an intake passage 11 of an engine 14 to be mounted on an unillustrated automotive vehicle. Inside the air cleaner 13, an air flow sensor 8 is arranged to detect the flow rate of air which flows through the intake passage 11. The air cleaner 13 is also provided with an intake air temperature sensor 9 adapted to detect the temperature of air passing through the air cleaner 13. In the intake passage 11 on the other hand, a throttle valve 12 connected to an accelerator pedal (not shown) as an artificial acceleration control member is provided at a point downstream the air cleaner 13. The throttle valve 12 as an engine power control element is provided with a throttle opening rate sensor 6 for detecting the opening rate of the throttle valve 12 over the entire range thereof and an idle switch 10 for detecting in an ON/OFF fashion whether the opening rate of the throttle valve 12 is at an idling position (the fully-closed position) or not. In addition, an electromagnetic fuel injection valve (hereinafter called "injector") 2 is provided within the intake passage 11 at a point downstream the point where the throttle valve 12 is provided. A fuel having a feed pressure, which has been controlled so as to maintain constant its difference from the internal pressure of the intake passage 11, is guided to the injector 2. The injection quantity of the fuel to the engine 14 is therefore set on the basis of the opening time of the valve of the injector 2. On the other hand, a three-way catalyst 16 is interposed in an exhaust passage 15 of the engine 14. Within the exhaust passage 15, a linear air/fuel ratio sensor 7 whose output varies linearly in accordance with the oxygen concentration in the exhaust passage 15, is provided at a point upstream the point of the three-way catalyst 16. (Incidentally, this linear air/fuel ratio sensor 7 may be replaced by an oxygen sensor whose output varies stepwise in the vicinity of a stoichiometric air/fuel ratio, where no feedback control of the air/fuel ratio is performed during lean burn.)

The engine 14 is provided further with a coolant temperature sensor 5 for detecting the temperature of its coolant and a crank angle sensor 3 for detecting its crank angle (information on the revolution number of the engine can be detected by measuring the time interval of discrete crank pulse signals generated from the crank angle sensor 3 by means of a timer of a control unit 1 to be described subsequently, in other words, the crank angle sensor 3 also functions as a revolution number sensor for detecting the revolution number of the engine). Likewise detection results of other sensors (air flow sensor 8, intake air temperature sensor 9, throttle opening rate sensor 6, idle switch 10 and linear air/fuel ratio sensor 7), detection results of these coolant temperature sensor 5 and crank angle sensor 3 are input to the control unit 1 composed principally of a microcomputer. The control unit 1 is also inputted with detection results of an unillustrated vehicle speed sensor which detects the speed of the automotive vehicle carrying the engine 14 mounted thereon. The control unit 1 then computes the amount of the fuel, which is to be fed to the engine 14, on the basis of information inputted from the individual sensors and outputs a signal to the injector 2 on the basis of results of the computation. Here, the functional relation between intake air flow rates Q and standard injection quantities $T_b$ ($T_b = K \times Q$; K: proportional constant) and functional relations between information on various operation states and correction coefficients have been inputted beforehand in a ROM as a memory of the control unit 1. At the control unit 1, the standard injection quantity $T_b$ and various correction coefficients are determined on the basis of information inputted from the various sensors, the standard injection quantity $T_b$ and various correction coefficients are then put together to obtain a final fuel injection quantity data $T_{inj}$ (valve opening time data on the injector 2), and the fuel injection quantity data is then fed to the injector 2.

As the above-mentioned correction coefficients, may be mentioned a warm-up correction coefficient $K_{wt}$ to be set in accordance with the temperature of the coolant of the engine, an air/fuel ratio correction coefficient $K_{af}$ to be set for each operation zone, an intake air temperature correction coefficient $K_{at}$ to be set depending on the temperature of intake air, an acceleration-related injection-quantity increasing coefficient $K_{ac}$ to be set by detecting a rapid acceleration, etc. (Besides, are also set usually a start-up correction coefficient on the basis of detection of a start-up, a wattless time correction coefficient responsive to a change of the voltage of a battery). Among these, the air/fuel ratio correction coefficient $K_{af}$ is determined as the product of an air/fuel ratio open correction coefficient $K_{op}$ and an air/fuel ratio feedback correction coefficient $K_{fb}$. In this case, the air/fuel ratio open correction coefficient $K_{op}$ is set at a value slightly greater than 1 in accordance with the state of load and revolution number of the engine in Zone ① (i.e., a high-load zone) in the operation state diagram shown in FIG. 2, so that an air/fuel ratio slightly smaller than a stoichiometric air/fuel ratio is obtained. In Zone② (namely, a high-speed zone), it is set at 1 or a value slightly smaller than 1 in accordance with the state of load and revolution number so as to obtain the stoichiometric air/fuel ratio or an air/fuel ratio slightly greater than the stoichiometric air/fuel ratio. It is set at 1 in Zone ③ so as to obtain the stoichiometric air/fuel ratio. In Zone ④, it is set at a value smaller than 1 in order to obtain an air/fuel ratio (e.g. 20–22) greater than the stoichiometric air/fuel ratio. On the other hand, the feedback correction coefficient $K_{fb}$ is always set at 1 in the abovementioned Zones ① and ②, because the feedback control of the air/fuel ratio is not performed there. In Zones ③ and ④, the feedback correction coefficient $K_{fb}$ is set based on detection results of the above-described linear air/fuel ratio sensor 7 when the feedback control of the air/fuel ratio is conducted. It is however set at 1 when the feedback control of the air/fuel ratio is not performed, for example, when the engine is cold or the linear air/fuel ratio sensor 7 is in an inactive state. (By the way, when an oxygen sensor (λ sensor) whose output changes either stepwise or extremely in the vicinity of the stoichiometric air/fuel ratio only is used as an air/fuel ratio sensor, the feedback correction coefficient $K_{fb}$ is always set 1 in Zone ④ because the feedback control of the air/fuel rat is not performed at lean air/fuel ratios.)

Incidentally, when a starting state of the vehicle is detected, the air/fuel ratio control in Zone ④ is switched over to a control similar to that performed in Zone ③ in order to improve the take-up characteristics as will be described in detail subsequently.

A control similar to that performed in Zone ③ is hence performed provided that the logical sum is established between the following Condition I and Condition II (in other words, the following Condition I and/or Condition II is met), even when the engine is operated in a lean air/fuel ratio control zone (i.e., Zone (1).

Condition I:

A time period from a time point at which the idle switch has been turned from the ON state to the OFF state until the detection of either one of the lapse of a predetermined time period (for example, 6 seconds) and the first exceeding of the time-dependent change rate of the throttle valve opening rate beyond a predetermined negative value after the above time point, while the vehicle speed is not higher than a predetermined low speed (for example, during the standing of the vehicle) and the engine revolution number Ne is smaller than a predetermined low revolution number (for example, at idling).

Condition II:

A time period until the engine revolution increment $\Delta N_e$ becomes equal to or smaller than a predetermined positive value $N_2$ when the increment $\Delta N_e$ has exceeded another predetermined positive value $N_1$ ($N_1 > N_2$) while Condition I is met.

When the increment of the engine revolution number does not exceed $N_1$ while Condition I is met, the control in Zone ④ is returned to the lean air/fuel ratio control as soon as Condition I becomes no longer satisfied (namely, at a time point where either one of the lapse of the predetermined time period since the change-over of the idle switch from the ON state to the OFF state and the first exceeding of the time-dependent change rate of the throttle valve opening rate beyond the predetermined negative value after the above change-over is detected). After the establishment of Condition II, the control in Zone ④ is also returned to the lean air/fuel ratio control as soon as Condition II becomes no longer satisfied (namely, as soon as the increment $\Gamma N_e$ of the engine revolution number becomes equal to or smaller than $N_2$).

Figure 3:
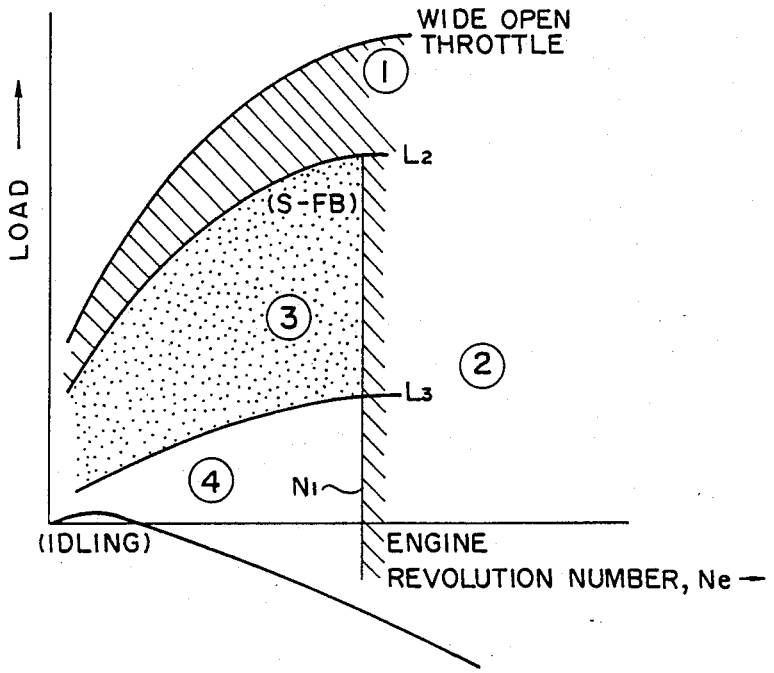

The boundary between Zone ① and Zone ③ and that between Zone ③ and Zone ④ each set depending on the engine load level. This engine load level is obtained from a value Q/N which is in turn obtained by dividing the intake air quantity information Q from the air flow sensor 8 with the revolution number information N from the revolution number sensor 3. The load level dividing Zone ③ and Zone ④ is caused to shift toward the side of lower loads at the time of an acceleration as illustrated in FIG. 3. At the above acceleration, Zone ③ (i.e., stoichiometric air/fuel ratio feedback zone = stoichiometric feedback zone) is enlarged whereas Zone ④ (i.e., lean air/fuel ratio feedback zone) is rendered narrower, both, compared with the corresponding zones at the time of an ordinary operation with a view toward improving the acceleration feeling. Namely, it is discriminated to be the time of an acceleration when the logical sum of the following Condition III and Conditions IV is established, whereby an enlargement of the stoichiometric air/fuel ratio feedback zone is effected. (This enlargement is effected usually by changing an air/fuel ratio map to another air/fuel ratio map, both stored in the ROM of the control unit 1).

Condition III:

A time period from a time point at which the time-dependent change rate ($d\theta/dt$) of the throttle valve opening rate has exceeded a predetermined positive value until the detection of either one of the lapse of a predetermined time period from the above time point (for example, 2 seconds) and the first exceeding of the time-dependent change rate of the throttle valve opening rate beyond a predetermined negative value after the above time point.

Condition IV:

A time period until the engine revolution increment $\Delta N_e$ becomes equal to or smaller than a predetermined determined positive value $N_4$ when the increment $\Delta N_e$ has exceeded another predetermined positive value $N_3$ ($N_3 \geqq N_4$, for example, $N_3 = N_4 = 8$ rpm) while Condition III is met.

When the increment of the engine revolution number does not exceed $N_3$ while Condition III is met, the enlarged control in Zone ③ is stopped as soon as Condition III becomes no longer satisfied (namely, at a time point where either one of the lapse of the predetermined time period since the exceeding of the time-dependent change rate of the throttle valve opening rate beyond the predetermined positive value and the first exceeding of the time-dependent change rate of the throttle valve opening rate beyond the predetermined negative value after the above exceeding of the time-dependent change rate of the throttle valve opening rate beyond the predetermined positive value is detected). After the establishment of Condition IV, the enlarged control in Zone ③ is also stopped as soon as Condition IV becomes no longer satisfied (namely, as soon as the increment $\Delta N_e$ of the engine revolution number becomes equal to or smaller than $N_4$).

A fuel control of the engine, which includes controls at starting and acceleration respectively, will next be described with reference to a flow chart.

The fuel control in this embodiment is performed on the basis of a first timer interruption routine which is performed in synchronization with an interrupt signal generated every first predetermined time (for example, 400 msec), a second timer interruption routine which is performed in synchronization with an interrupt signal generated every second predetermined time (for example, 25 msec), an injector drive interruption routine which is performed most preferentially in synchronization with each crank pulse from the crank angle sensor 3, and a main routine which is normally performed when none of these interruption routines are performed.

Figure 4:
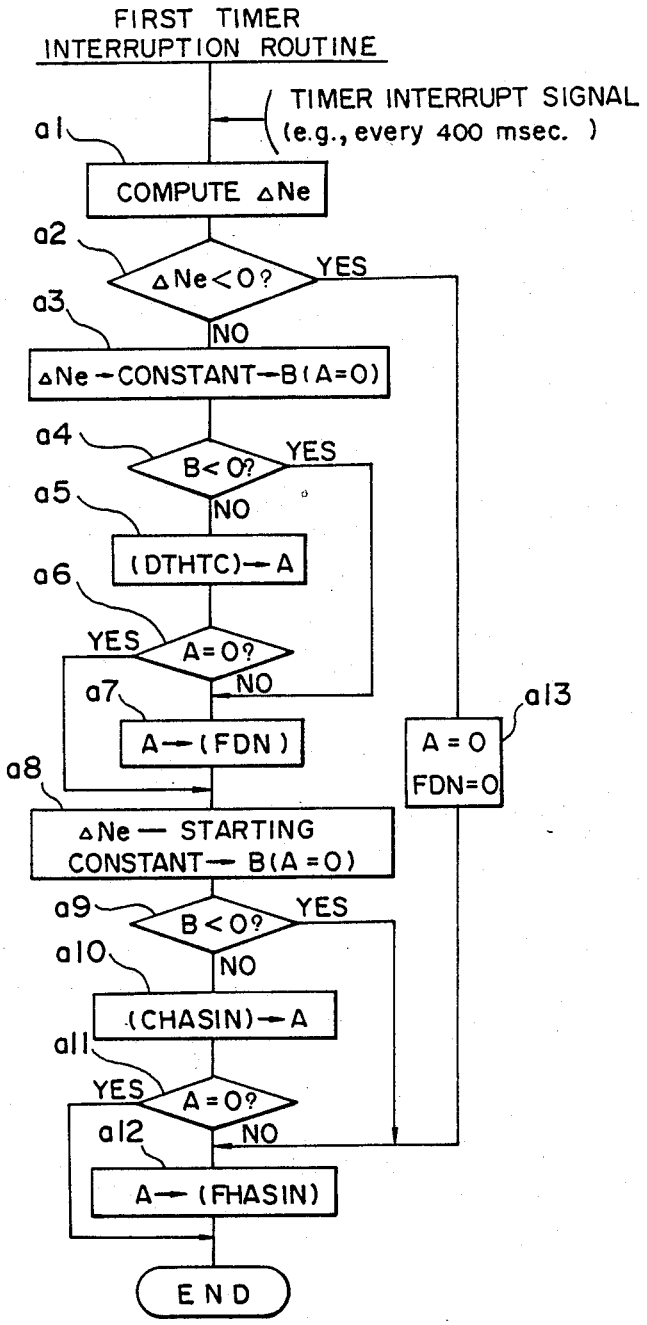
FIGS. 4–7 are flow charts illustrating respectively control modes of the air/fuel ratio in the embodiment.

First of all, in the first timer interruption routine illustrated in FIG. 4, an engine revolution number information $N_e$ determined based on an output from the crank angle sensor 3 in the injector drive interruption routine is inputted and then compared with an engine revolution number information already inputted at the time of performance of the preceding routine, the time-dependent change rate $\Delta N_e$ of the engine revolution number is computed based on the difference between both pieces of information, the revolution number information inputted in the present routine is stored in a prescribed storage address in a RAM (Step al), the change rate $\Delta N_e$ is then discriminated not to be negative (Step a2), a value obtained by subtracting a rapid acceleration constant $N_a$ from the change rate $\Delta N_e$ is stored in an address B of the RAM of the control unit 1 and at the same time the contents (data) of an address A of the RAM are cleared (Step a3), and when the data of the address B is positive or 0 (namely, $\Delta N_e \geqq N_a$) (Step a4), the data of an address DTHTC of the RAM which address DTHTC constitutes a stoichiometric feedback (S-FB) enlarging zone is inputted in the address A (Step a5). Regarding the data of DTHDC, its initial value is inputted at the time of detection of an accelerating operation in the second timer interruption routine illustrated in FIG. 5. In the same routine, subtractions are performed one after another subsequent to the above input and the date of DTHDC is reduced to 0 upon an elapsed time of a predetermined period of time (for example, 2 seconds).

Figure 2:
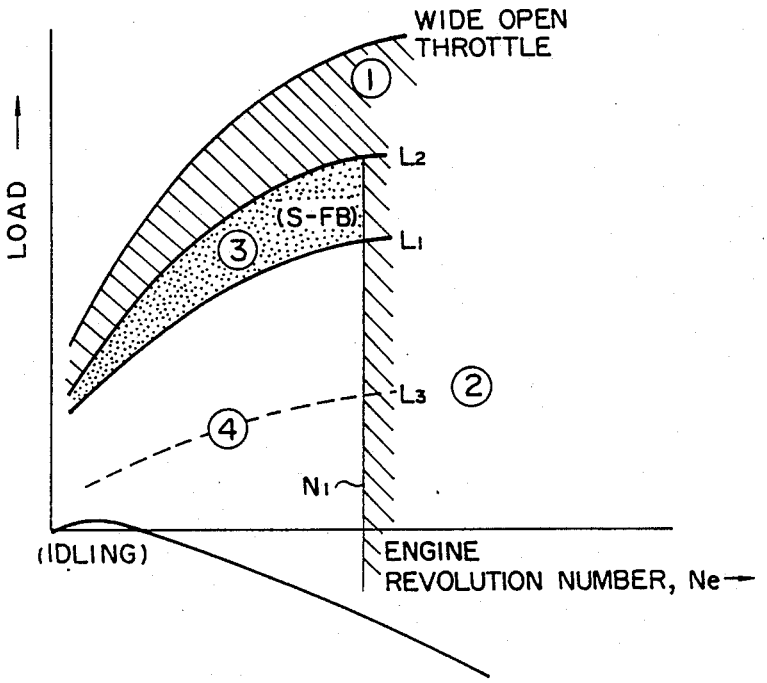
FIGS. 2 and 3 diagrammatically depict air/fuel ratio control characteristics in the embodiment.

It is then discriminated in Step a6 whether the data of DTHTC stored in the address A has been reduced to 0, in other words, whether the predetermined period of time has been passed by. When $A \neq 0$, the contents of the address A are inputted to an address FDN of the RAM, which address FDN constitutes an S-FB zone enlargement discrimination flag (Step a7). When $A=0$, Step a7 is jumped over. Incidentally, the data of the address FDN is used upon selection of an air/fuel map in the main routine depicted in FIG. 6. In the main routine, as will be described subsequently, an air/fuel ratio map having the characteristics shown in FIG. 2 is selected as the air/fuel ratio map when the data of FDN is 0. When the data of FDN is not 0 on the other hand, an air/fuel ratio map having the characteristics shown in FIG. 3 (namely, with an enlarged S-FB zone) is selected as the air/fuel ratio map.

When the change rate $\Delta N_e$ is negative in Step a2 (namely, when the engine is operated at a reduced speed), the data of the address A is cleared in Step a13 and the data of the address FDN is also cleared (namely, the S-FB zone enlargement discrimination flag is reset). In Step a12, the thus-cleared data (namely, 0) of the address A is thereafter inputted in an address FHASIN of the RAM, which address FHASIN constitutes a lean air/fuel ratio control inhibition flag. The data of the address FHASIN is used in the main routine depicted in FIG. 6. When the data of FHASIN is not 0, the lean air/fuel ratio control is inhibited.

When the data of the address B is negative (namely, $\Delta N_e < N_a$) in Step a4, the data of the address A (in this embodiment, 0 set in Step a3) is inputted in the address FDN.

In the manner described above, the data of the address FDN which is to be used for the enlargement of the S-FB zone at the time of an acceleration is set in Step a1–Step a7 or a13.

In Step a8 next, the value obtained by subtracting the starting constant $N_s$ from the change rate $\Delta N_e$ of the engine revolution number is inputted in the address B and at the same time, the data of the address A is cleared. When the data of the address B is either positive or 0 (namely, $\Delta N_e \geqq N_s$) (Step 9), the data of the address CHASIN of the RAM, said address CHASIN constituting the starting S-FB counter, is inputted in the address A (Step a10). Here, CHASIN constitutes the counter, which is controlled in such a way that an initial value is inputted when a starting state is detected in the main routine to be described subsequently, and the initial value is subtracted little by little in the second timer interruption routine so as to reduce the data of the counter to 0 upon lapse of a predetermined time period (6 seconds, for example) after the detection of the starting state.

In Step all, it is discriminated if the data of CHASIN stored in the address A has been reduced, in other words, a predetermined time period (6 seconds, for example) has passed by. When $A \neq 0$, the data of the address A is inputted as a lean air/fuel ratio control inhibition flag in the address FHASIN (Step a12). Step a12 is however jumped over when $A = 0$.

When the data of the address B is negative (namely, $\Delta N_e < N_s$) in Step a9, the data of the address A (in this embodiment, 0 set in Step 8) is set in the address FHASIN. When the data of the address FHASIN is 0, the inhibition of the lean air/fuel ratio control is not effected as will be described subsequently.

The setting of the data of the address FHASIN, which governs the flag for the inhibition of the lean air/fuel ratio control at the time of starting, is performed in Step a8–Step a12 in the manner described above.

When the end of the program is reached directed from Step all or by way of Step a12, a standby state is established to wait for a next timer interrupt signal to be generated upon lapse of a first predetermined time period (e.g., 400 msec).

Figure 5:
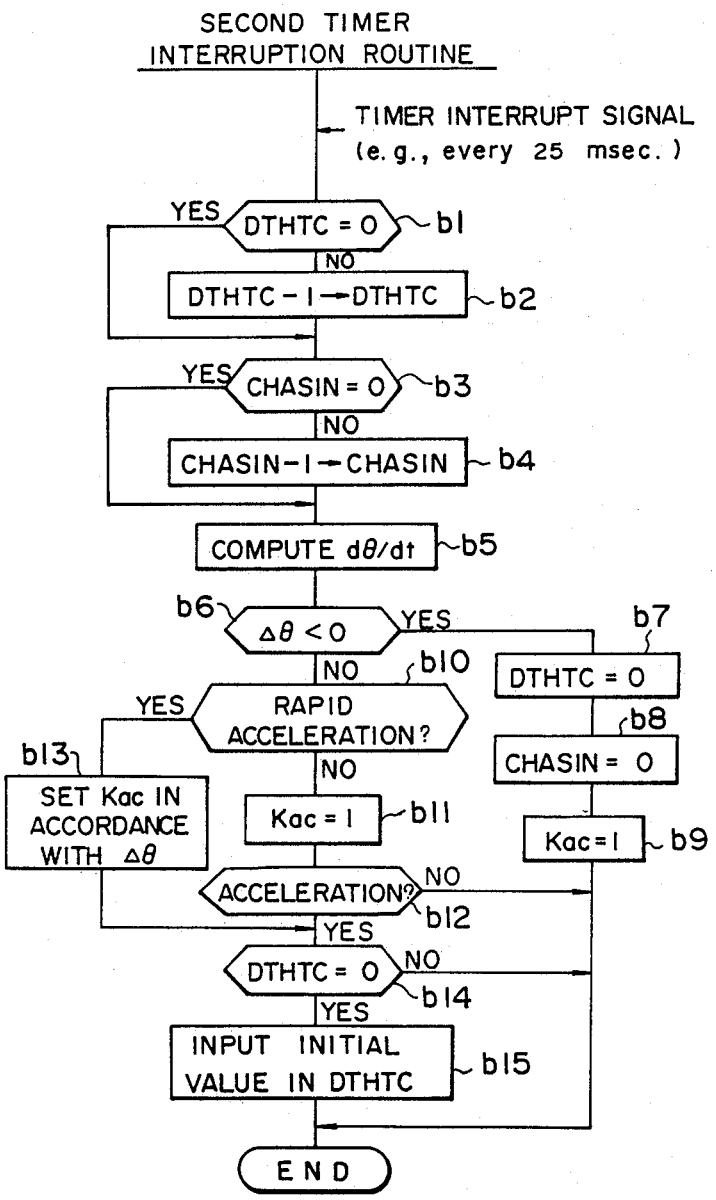

The second timer interruption routine shown in FIG. 5 will next be described.

The second timer interruption routine is performed every predetermined second time (for example, 25 msec) shorter than the above-described first predetermined time. First of all, it is discriminated in Step b1 whether the data of the address DTHTC is 0 or not. When it is not 0 (namely, when it is a positive value), 1 is subtracted from the data of the address DTHTC in Step b2 to reach Step b3. When the data of the address DTHTC is discriminated to be 0 in Step b1 on the other hand, Step b2 is jumped over to reach Step b3. In Step b3, it is discriminated whether the data of the address CHASIN is 0 or not. When it is not 0 (namely, when it is a positive value), 1 is subtracted from the data of the address CHASIN in Step b4 to reach Step b5. When the data of the address CHASIN is discriminated to be 0 in Step b3 on the other hand, Step b4 is jumped over to reach Step b5.

In Step b5, an output $\theta$ from the throttle valve opening rate sensor 6 is inputted. This inputted data is compared with an output inputted from the throttle valve opening rate sensor 6 in the same step (Step b5) at the time of preceding performance of the routine and based on their difference, the time-dependent change rate $\Delta\theta$ of the throttle valve opening rate is computed. After completion of this computation, the newly inputted data on the throttle valve opening rate is stored in a prescribed address of the RAM. In Step b6 next, it is discriminated whether the time-dependent change rate $\Delta\theta$ of the throttle valve opening rate determined in Step b5 is negative or not. When it is discriminated to be negative, the data of the addresses DTHTC and CHASIN are reset to 0 in Steps b7 ad b8 respectively, and in Step b9, the acceleration-related injection-quantity increment coefficient $K_{ac}$ to be used in the injector drive interruption routine, which will be described subsequently, is set at 1 so as to finish this routine.

When the value of $\Delta\theta$ is discriminated to be 0 or positive in Step b6 on the other hand, it is discriminated in Step b10 whether a rapid acceleration is under way or not.(namely, whether the value of $\Delta\theta$ is greater than a predetermined first positive value $\theta$A). When no rapid acceleration is discriminated to be under way, the acceleration-related injectionquantity increment coefficient $K_{ac}$ is set at 1 in Step b11 and thereafter, it is discriminated in Step b12 whether an acceleration of at least a certain degree is under way or not (namely, whether the value of $\Delta\theta$ is greater than a predetermined second positive value $\theta$B smaller than the predetermined first positive value $\theta$A). When it has been discriminated that an acceleration of the certain degree or greater is under way, Step b14 is reached. Otherwise, the routine is finished. When it has been discriminated in Step b10 that a rapid acceleration has been performed, an acceleration-related injection-quantity increasing coefficient $K_{ac}$ ($K_{ac}>1$) corresponding to the value of $\Delta\theta$ is set in Step b13 and Step b14 is reached.

In Step b14, it is discriminated whether the data of the address DTHTC is 0 or not. When it is 0, an initial value (80, for example) is inputted to the address DTHTC in Step b15 to finish the routine. When the data of the address DTHTC is discriminated not to be 0 ($>0$) in Step b14 on the other hand, the input of the initial value to the address is not performed and the routine is finished without any further operation. Once the routine is finished, an operation standby state is established until a next interrupt signal is generated upon lapse of a second predetermined time period.

Figure 6:
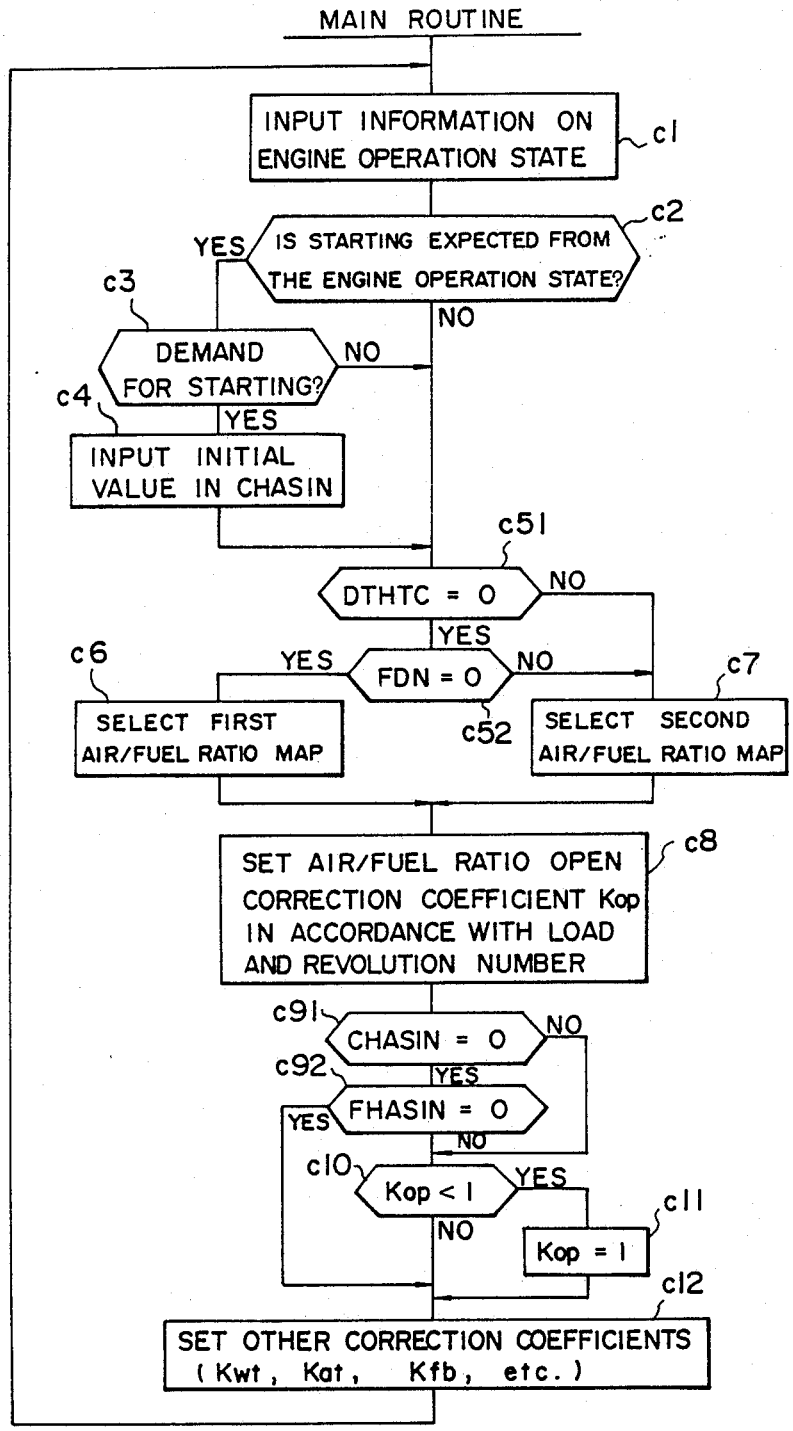

A description will next be made of the main routine shown in FIG. 6.

In the main routine which is performed endlessly during an operation of the engine when no other program processing is performed on the basis of an interrupt signal, the input of an operation state of the engine is performed first of all on the basis of outputs from the above-mentioned various sensors in Step cl, and in Step c2, it is discriminated whether the engine is in an operation state from which starting of the vehicle can be expected. Specifically, this discrimination in Step c2 is performed based on detection results by the vehicle speed sensor and detection results by the engine revolution number sensor (crank angle sensor 3). When the vehicle speed is not faster than an extremely low vehicle speed (for example, while the vehicle is standing) and the engine revolution number is not greater than a predetermined value (for example, an idling revolution number), the vehicle is discriminated to be in an operation state indicative of its starting so that the routine proceeds to Step c3. The routine proceeds to Step c51 when even at least one of the vehicle speed conditions and engine revolution conditions is no longer satisfied.

When it is discriminated in Step c2 that the engine is in an operation state from which starting of the vehicle can be expected, it is then discriminated in Step c3 whether a demand for starting has been made by the driver, namely, whether the accelerator pedal has been depressed by the driver. This discrimination is carried out specifically depending whether the idle switch 10 has been changed from the ON position to the OFF position. When the change of the switch 10 from the ON position to the OFF position is detected, an initial value (for example, 240) is inputted to the address CHASIN in Step c4 and the routine then advances to Step c51. When the change of the switch 10 from the ON position to the OFF position is not detected on the other hand, Step c4 is jumped over and the routine advances to Step c51.

In Step c51, it is discriminated whether the data of the address DTHTC set in the second timer interruption routine is zero or not (namely, whether the S-FB zone enlargement counter is zero or not). When it is zero, the routine advances to Step c52. When it is not zero on the other hand, the routine jumps over Step c52 and advances to Step c7. In Step c52, it is discriminated whether the data of the address FDN set in the first timer interruption routine is zero or not (namely, whether the S-FB zone enlargement flag has been reset or not). When it is zero, it is judged that the enlargement of the S-FB zone is unnecessary and the first air/fuel ratio map having the characteristics shown in FIG. 2 is selected from the ROM in Step c6. In Step c8, a value corresponding to the load state and revolution number of the engine is read out from the first air/fuel ratio map and the value thus read out is set as the air/fuel ratio open correction coefficient $K_{op}$. When it is on the other hand discriminated in Step c52 that the data of the address FDN is not 0, the enlargement of the S-FB zone by an ordinary acceleration is judged to be necessary. The second air/fuel ratio map having the characteristics depicted in FIG. 3 is then selected from the ROM in Step c7, and a value corresponding to the load state and revolution number of the engine are read out from the second air/fuel ratio map and the value thus read out is set as the air/fuel ratio open correction coefficient $K_{op}$.

Incidentally, the above-mentioned load state of the engine is set based on a value obtained by dividing the quantity of air, which has passed by the air flow sensor 8 per unit time, with the revolution number of the engine (namely, the quantity of air drawn into each combustion chamber per stroke of the engine). In this embodiment, the specific operation zone in which the engine is operated at a lean air/fuel ratio is discriminated by detecting the state of operation of the engine on the basis of the outputs of the air flow sensor 8 and crank angle sensor 3. An operation zone discriminating means is thus composed of these sensors. On the other hand, the control unit 1 is equipped with the first air/fuel ratio map in the ROM in order to have the engine operated at a lean air/fuel ratio, thereby functioning as a lean air/fuel ratio setting means.

It is then discriminated in Step c91 whether the data of the address CHASIN set in the second timer interruption routine is zero or not (namely, whether the staring S-FB counter is zero or not). When it is zero, the routine advances to Step c92. When it is not zero on the other hand, the routine jumps over Step c92 and advances to Step c10. It is then discriminated in Step c92 whether the data of the address FHASIN set in the first timer interruption routine is zero or not (namely, whether the lean air/fuel ratio control inhibition flag has been reset or not). When it is not zero (when the vehicle is under starting acceleration), it is judged that the inhibition of the lean air/fuel ratio control is instructed, and it is discriminated in Step c10 whether the air/fuel ratio open correction coefficient $K_{op}$ is smaller than 1 or not (whether the lean control is to be performed or not). When $K_{op}<1$, $K_{op}$ is corrected to 1 in Step c11 (whereby the air/fuel ratio of an air-fuel mixture to be fed to the engine is controlled to the stoichiometric ratio) and the routine advances to Step c12. When $K_{op}\geqq 1$ in Step c10 on the other hand, Step c11 is jumped over and the routine advances to Step c12. When the data of the address FHASIN is discriminated to be zero in Step c92 on the other hand, it is judged that the vehicle is not under starting acceleration, and the routine jumps over Steps c10 and c11 and advances to Step c12.

In Step c12, other correction coefficients (for example, the warm-up correction coefficient $K_{wt}$, intake air temperature correction coefficient $K_{at}$, etc.) for setting the injection quantity of the fuel are computed on the basis of various information on the operation state of the engine. After completion of this computation, the processing from Step cl is repeated again.

By the way, the control unit 1 functions as the lean air/fuel ratio setting means through the performance of Step c6 of the main routine and also functions as the air/fuel ratio enrichment control means through the performance of Steps c51,c52,c7 and Steps c91,c92,c11 of the same routine.

Figure 7:
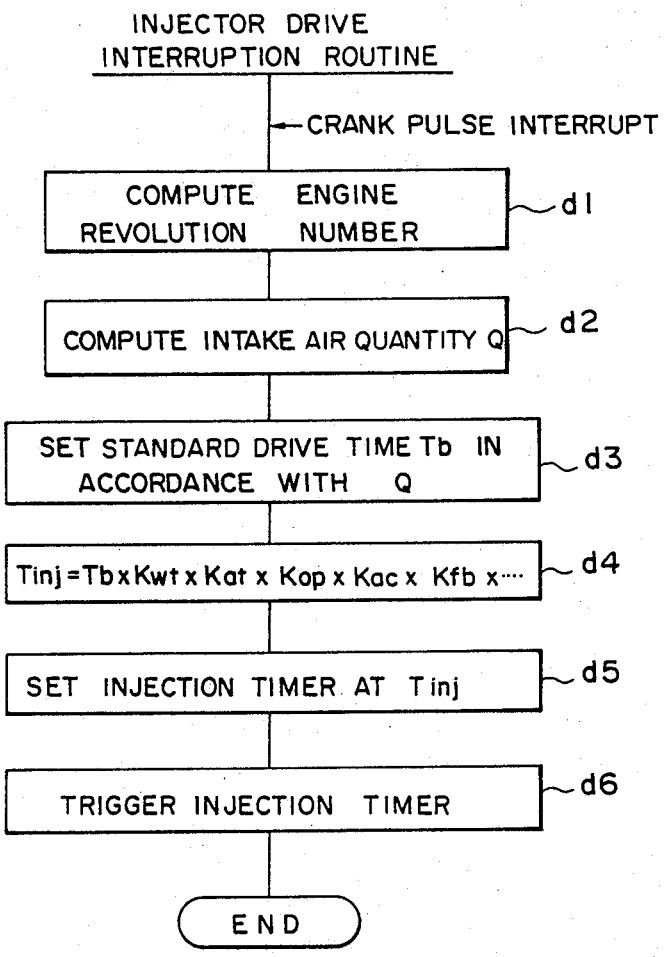

A description will next be made of the injector drive interruption routine illustrated in FIG. 7.

This routine is performed in synchronization with crank angle signals from the crank angle sensor 3. First of all, the time interval of adjacent crank pulses is measured by a clock in Step d1. Based on the results of the measurement, the engine revolution number information $N_e$ is computed, the quantity Q of air drawn into the engine 14 between each two adjacent crank pulses, namely, from the time point of the preceding injection until the time point of the current injection is computed based on the output of the air flow sensor 8 in Step d2, and the basic injection quantity information (standard drive time) $T_b$ is thereafter set in accordance with the air quantity information Q in Step d3.

In Step d4, the value of the basic injection quantity information $T_b$ is then corrected by various correction coefficients including the air/fuel ratio open correction coefficient $K_{op}$, thereby obtaining the valve opening time data $T_{inj}$ for the injector 2. This data $T_{inj}$ is thereafter set in an unillustrated injector drive timer in Step d5 and the timer is triggered in Step d6. (Accordingly, the valve of the injector 2 is opened for a time period set by the data $T_{inj}$ so as to feed the fuel to the engine.) Upon completion of Step d6, this routine is brought into a standby state so as to wait for a next crank pulse interruption.

The operation of the present embodiment will hereinafter be described.

Figure 8:
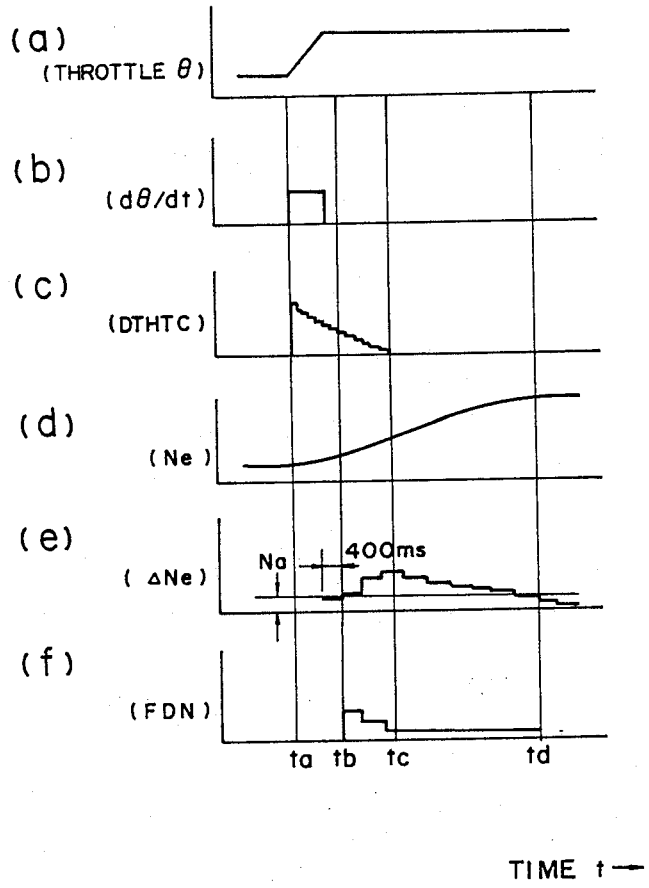
FIGS. 8 and 9 diagrammatically show the operation of the embodiment.

Let's first assume that the driver of the vehicle, which is running at a constant speed, operates the accelerator pedal at a time point $t_a$ so as to accelerate the vehicle to at least a certain extent. The throttle valve opening rate $\theta$ then varies as shown in FIG. 8(*a*) and its time-dependent change rate ($d\theta/dt$) hence varies as illustrated in FIG. 8(*b*). The value of this time-dependent change rate $d\theta/dt$ computed in Step b5 of the second timer interruption routine indicates an accelerated state of the above-mentioned certain extent or higher. This is detected in Step b10 or b12 of the same routine. (Incidentally, the throttle opening rate sensor 12 serves as an acceleration command detecting means in this case.)

Accordingly, as shown in FIG. 8(*c*), an initial value is inputted to the address DTHTC immediately after the initiation of the accelerating operation and the data of DTHTC then maintains a positive value for a predetermined period of time (2 seconds, for example) while being subtracted little by little. Based on the discrimination in Step c51 of the main routine, the air/fuel ratio control (S-FB zone enlargement control) of the engine is hence performed for the above predetermined period of time (2 seconds, for example) in accordance with the characteristics depicted in FIG. 3.

When the actual revolution number of the engine increases, as illustrated in FIGS. 8(*d*) and 8(*e*), beyond the predetermined revolution number increment $N_a$ at a time point $t_b$ at which the data address DTHTC has not still reached 0 (namely, before a time point $t_c$), the above increase is detected in Step a4 of the first timer interruption routine and as shown in FIG. 8(*f*), the data of the address DTHTC is inputted to the address FDN until the data of the address DTHTC is about to reach 0. After the time point at which the data of the address DTHTC becomes 0 (i.e., the time point $t_c$), the data of the address DTHTC right before its reduction to 0 is maintained in the address FDN (Steps a6 and a7 of the first timer interruption routine). Since a positive value is still maintained in the address FDN even at the time point where the data of the address DTHTC has reached 0, the air/fuel ratio control (S-FB zone enlargement control) is still performed continuously in accordance with the characteristics shown in FIG. 3 on the basis of the discrimination in Step c52 of the main routine.

When a sufficient time period has passed (time point $t_d$) since the accelerating operation was performed and the increment of the engine revolution number has ceased, the discrimination in Step a4 of the first timer interruption routine is reversed and the data of the address FDN is reduced to 0. As a result, the S-FB zone enlargement control is stopped on the basis of the discrimination in Step c52 of the main routine and the air/fuel ratio control of the engine is performed in accordance with the characteristics depicted in FIG. 2.

When any actually accelerated state of the engine (namely, the exceeding of the increment $N_a$ of the engine revolution number beyond the predetermined positive value) is not detected from the time point at which the accelerating operation was performed by the driver (the time point $t_a$) until the time point at which the data of the address DTHTC has reached 0 (the time point $t_c$) or when the termination of an actually accelerated state of the engine (namely, the falling of the increment of the engine revolution number beyond the predetermined positive value) is detected before the arrival at the time point $t_c$ even if an actually accelerated state of the engine is detected between the time point $t_a$ and the time point $t_c$, the S-FB zone enlargement control is terminated upon lapse of a predetermined time period (for example, 2 seconds) after the time point $t_c$, namely, after the accelerating operation by the driver since the data of the address FDN inputted in Step a7 of the first timer interruption routine has been reduced to 0 at the time point $t_c$. As a consequence, the air/fuel ratio control of the engine is thus performed in accordance with the characteristics shown in FIG. 2.

Figure 9:
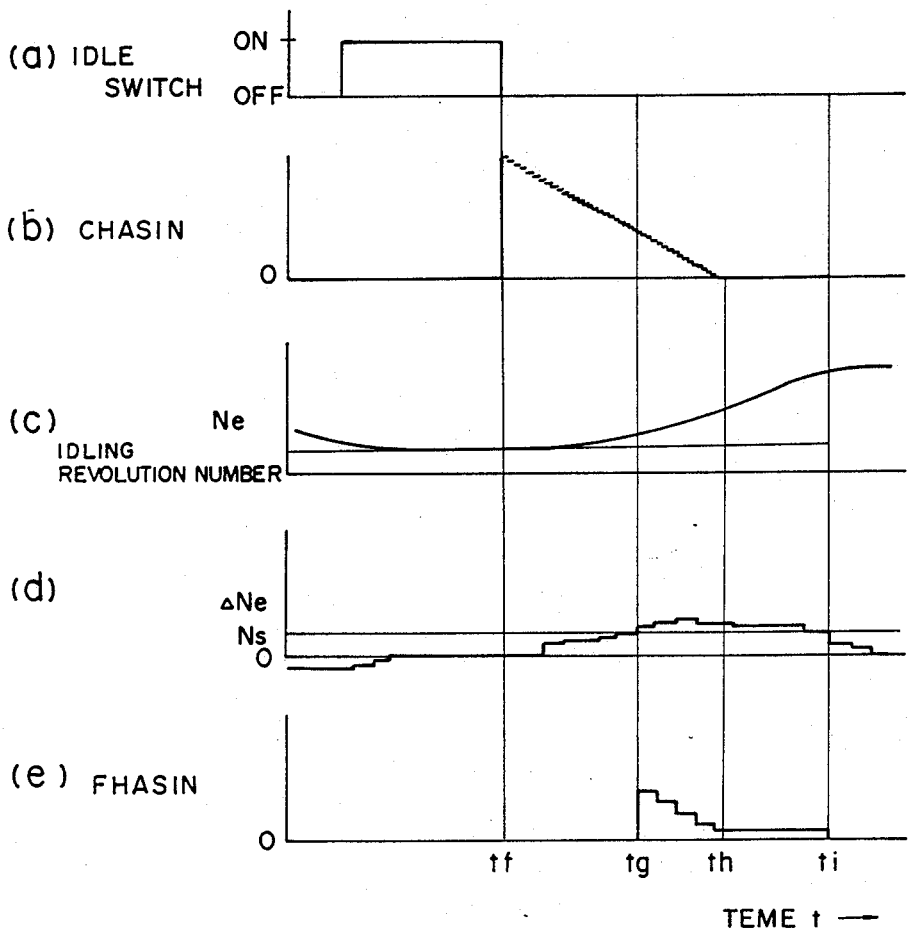

When the driver depresses the accelerator pedal at idling in the standing of the vehicle so as to start the vehicle, the idle switch 10 as the acceleration command detecting means is changed over from the ON state to the OFF state (at the time point $t_f$) as shown in FIG. 9(*a*). At a time point where the changeover of the idle switch 10 from the ON state to the OFF state has detected in Step c3 of the main routine, an initial value is inputted to the starting S-FB counter (the address CHASIN). Thereafter, the data of the address CHASIN maintains a positive value for a predetermined time period (for example, 6 seconds) while being subtracted little by little. As a consequence, the leaning of the air/fuel ratio is inhibited for the above predetermined time period (for example, 6 seconds) on the basis of the discrimination in Step c91 of the main routine.

When the actual revolution number of the engine exceeds, as illustrated in FIGS. 9(*c*) and 9(*d*), beyond a predetermined revolution number increment $N_s$ after a time point $t_g$ which is still before the data of the address CHASIN reaches 0 (i.e., a time point $t_h$), this increase is detected in Step a9 of the first timer interruption routine. As a consequence, the data of the address CHASIN is inputted to the address FHASIN until the data of the address CHASIN is about to reach 0. After the data of the address CHASIN has reached 0 (the time point $t_h$), the data of the address CHASIN immediately before it became 0 is maintained in the address FHASIN (Steps all and a12 of the first timer interruption routine). Since a positive value is still maintained in the address FHASIN even when the data of the address CHASIN has reached 0, the inhibition of the leaning of the air/fuel ratio is continuously effected on the basis of the discrimination of Step c92 of the main routine.

When a sufficient time period has passed (a time point $t_i$) since the starting and accelerating operation was performed and the increment of the engine revolution number has ceased, the discrimination in Step a9 of the first timer interruption routine is reversed and the data of the address FHASIN is reduced to 0. As a result, the inhibition of the leaning of the air/fuel ratio is released on the basis of the discrimination in Step c92 of the main routine and the air/fuel ratio control of the engine is performed in accordance with the characteristics depicted in FIGURE 2 (or FIG. 3 when an ordinary acceleration is detected).

When any actually accelerated state of the engine (namely, the exceeding of the increment of the engine revolution number beyond the predetermined positive value $N_s$) is not detected from the time point at which the accelerating operation was performed by the driver (the time point $t_f$) until the time point at which the data of the address CHASIN has reached 0 (the time point $t_h$) or when the termination of an actually accelerated state of the engine (namely, the falling of the increment of the engine revolution number beyond the predetermined positive value $N_s$) is detected before the arrival at the time point $t_h$ even if an actually accelerated state of the engine is detected between the time point $t_f$ and the time point $t_h$, the inhibition of the leaning of the air/fuel ratio is released upon lapse of a predetermined time period (for example, 6 seconds) after the time point $t_h$, namely, after the accelerating operation by the driver since the data of the address FHASIN inputted in Step a12 of the first timer interruption routine has been reduced to 0 at the time point $t_h$.

According to the above embodiment, the leaning of the air/fuel ratio is therefore inhibited from the time point of initiation of an accelerating operation (depression of the accelerator pedal) by the driver until the termination of an actual acceleration of the engine when the standing vehicle is caused to start. The starting performance has hence been improved. When an acceleration is attempted at ordinary running (at steady state running), the stoichiometric feedback zone is enlarged from the time point of the initiation of the accelerating operation (depression of the accelerator pedal) by the driver until the termination of an actual acceleration of the engine, whereby the lean air/fuel ratio zone is reduced correspondingly and the operation is performed in a zone ranging from a relatively low-load operation zone to a zone close to the stoichiometric air/fuel ratio. It is hence possible to achieve natural acceleration feeling not departing from the intention of the driver. Especially, the changeover from an operation near the stoichiometric air/fuel ratio to an operation at a lean air/fuel ratio is effected at the time point of termination of an actual acceleration of the engine, where no excess torque is required. It is therefore possible to prevent the occurrence of a shock at this changeover.

In the above embodiment, an operation is performed near the stoichiometric air/fuel ratio on the basis of the inhibition of leaning of the air/fuel ratio and the reduction of the lean burn operation zone upon acceleration at starting and upon acceleration at ordinary running, respectively. It is however feasible to control in such a way that the air/fuel ratio of an air-fuel mixture to be fed to the engine is changed to a level richer than the stoichiometric air/fuel ratio upon acceleration at starting or ordinary running.

In the above embodiment, the air/fuel ratio map whose Zone③ is occupied by a stoichiometric feedback zone is used as the first air/fuel ratio map which is employed in a non-accelerated state and is stored in the ROM of the control unit 1. Like Zone④, Zone③ may be used as a lean air/fuel ratio control zone and lean burn may hence be performed in Zone③. (Namely, the stoichiometric feedback control is not performed at all at non-acceleration in this modified embodiment.)

Further, the air/fuel ratio map whose Zone④ is occupied by a lean air/fuel-ratio control is used as the second air/fuel ratio map (see FIG. 3) which is employed in an accelerated state and is stored in the ROM of the control unit 1. Like Zone③, Zone④ may be used as a stoichiometric feedback control zone and burning may hence be performed near the stoichiometric air/fuel ratio. (Namely, lean burn is not performed at all at acceleration in this modified embodiment.)

It is also feasible to use as the first air/fuel ratio map an air/fuel ratio map whose Zone③ set as a lean air/fuel ratio control zone like Zone④ and at the same time to employ as the second air/fuel ratio an air/fuel ratio map whose Zone 4 set as a stoichiometric feedback control zone like Zone 3.

In the above embodiment, the zone (Zone 2) higher than the revolution number $N_1$ in each of FIGS. 2 and 3 is used as a high-speed zone so as to obtain an air/fuel ratio either close to or somewhat leaner than the stoichiometric air/fuel ratio. Like Zone③ or④, Zone② may however be set to perform the lean air/fuel ratio control or stoichiometric air/fuel ratio control in accordance with the load level so that the controls may be used selectively depending whether the engine is in acceleration or not.

We claim:

1. An air/fuel ratio controller for an engine, said controller being equipped with an engine operation zone discriminating means for discriminating a specific operation zone of the engine on the basis of at least one operation parameter of the engine and a lean air/fuel ratio setting means for setting the air/fuel ratio of an air-fuel mixture, which is to be fed to the engine, at a level leaner than a stoichiometric air/fuel ratio upon receipt of an engine operation zone discriminating means, which comprises:

an engine power control element;

a means for detecting an acceleration command, which is generated to drive the engine power control element in an engine power increasing direction, on the basis of one of a state of actuation of the engine power control element and a state of actuation of an input side of the engine power control element;

a means for detecting an actually accelerated state of the engine, which is established responsive to the acceleration command, on the basis of a change in the revolution number of the engine;

an air/fuel ratio enriching means operable preferentially to said lean air/fuel ratio setting means so as to set the air/fuel ratio of the air/fuel mixture, which is to be fed to the engine, at a level richer than the air/fuel ratio leaner than the stoichiometric air/fuel ratio; and an air/fuel ratio enrichment control means for starting an operation of said air/fuel enriching means upon receipt of a signal from said acceleration command detecting means and for ending the operation of said air/fuel ratio enriching means upon receipt of another signal from said accelerated state detecting means;

whereby the air/fuel ratio of the air-fuel mixture to be fed to the engine is set at a level richer than the air/fuel ratio leaner than the stoichiometric air/fuel ratio by an operation of said air/fuel ratio enriching means from the time point of generation of the acceleration command until the end of an increase in the revolution number of the engine.

2. The air/fuel ratio controller as claimed in claim 1, wherein said air/fuel ratio enrichment control means causes said air/fuel ratio enriching means to start operating upon receipt of the signal from said acceleration command detecting means and causes said air/fuel ratio enriching means to cease operating upon receipt of said another signal from said accelerated state detecting means.

3. The air/fuel ratio controller as claimed in claim 1, wherein said accelerated state detecting means detects the actually accelerated state of the engine on the basis of a change in revolution number of the engine.

4. The air/fuel ratio controller as claimed in claim 1, wherein a timer means for generating a signal, which lasts from the starting time point of the acceleration command until the lapse of a predetermined period of time, based on detection results by said acceleration command detecting means is connected functionally to said acceleration command detecting means, said accelerated state detecting means continues to generate a signal from the time point of detection of initiation of the actually accelerated state of the engine or an accelerated state right after the initiation of the actually accelerated state until the detection of the termination of the actually accelerated state of the engine or an accelerated state right before the termination of the actually accelerated state when the initiation of the actually accelerated state of the engine or the accelerated state right after the initiation of the actually accelerated state is detected during the generation of the signal from said timer means, and said air/fuel ratio enrichment control means causes said air/fuel ratio enriching means to operate continuously during a period in which a logical sum is established between the signal from said acceleration command detecting means and the signal from said accelerated state detecting means.

5. The air/fuel ratio controller as claimed in claim 1, wherein said air/fuel ratio enriching means sets, at the stoichiometric air/fuel ratio, the air/fuel ratio of the air-fuel mixture to be fed to the engine.

6. An air/fuel ratio controller for an engine, said controller being equipped with a means for detecting the state of load of the engine and an air/fuel ratio setting means for changing the air/fuel ratio of an air-fuel mixture, which is to be fed to the engine, by using as a reference a first load level set upon receipt of a signal from said engine load state detecting means, thereby setting the air/fuel ratio of the air-fuel mixture at a level leaner than a stoichiometric air/fuel ratio in an operation state of a load level not higher than the first load level set as the reference but setting the air/fuel ratio of the air-fuel mixture at a level richer than the leaner level in an operation state of a load level exceeding the first load level set as the reference, which comprises:

an engine power control element;

a means for detecting an acceleration command, which is generated to drive the engine power control element in an engine power increasing direction, on the basis of one of a state of actuation of the engine power control element and a state of actuation of an input side of the engine power control element;

a means for detecting an actually accelerated state of the engine established responsive to the accelerated command; and a load level changing means for changing the first load level, which has been set as the reference by the air/fuel ratio setting means, to a second load level lower than the first load level upon receipt of a signal from said acceleration command detecting means and another signal from said accelerated state detecting means;

whereby the first load level of said lean air/fuel ratio setting means is maintained at the second load level by an actuation of said load level changing means while an actually accelerated state continues in the engine from the time point of generation of the acceleration command.

7. An air/fuel ratio controller for an engine, said controller being equipped with an engine operation zone discriminating means for discriminating a specific operation zone of the engine on the basis of at least one operation parameter of the engine and a lean air/fuel ratio setting means for setting the air/fuel ratio of an air-fuel mixture, which is to be fed to the engine, at a level leaner than a stoichiometric air/fuel ratio upon receipt of an engine operation zone discriminating signal from said engine operation zone discriminating means, which comprises:

an engine power control element;

a means for detecting an acceleration command, which is generated to drive the engine power control element in an engine power increasing direction, on the basis of one of a state of actuation of the engine power control element and a state of actuation of an input side of the engine power control element;

a means for detecting an actually accelerated state of the engine, which is established responsive to the acceleration command, on the basis of a change in the revolution number of the engine;

an air/fuel ratio enriching means operable preferentially to said lean air/fuel ratio setting means so as to set the air/fuel ratio of the air-fuel mixture, which is to be fed to the engine, at a level richer than the air/fuel ratio leaner than the stoichiometric air/fuel ratio; and an air/fuel ratio enrichment control means for setting both starting time and ending time of an operation of said air/fuel ratio enriching means upon receipt of a signal from said acceleration command detecting means and another signal from said accelerated state detecting means, respectively;

a timer means for generating a signal, which lasts from the starting time point of the acceleration command until the lapse of a predetermined period of time, based on detection results by said acceleration command detecting means, said timer means being functionally connected to said acceleration command detecting means;

said accelerated state detecting means being adapted to generate the signal from a time point that the revolution number increment of the engine has exceeded a predetermined positive value until another time point that the revolution number increment has become smaller than the predetermined positive value or another predetermined positive value smaller than the first-mentioned positive value; and said air/fuel ratio enrichment control means being adapted to cause said air/fuel ratio enriching means to operate continuously during a period in which a logical sum is established between the signal from said acceleration command detecting means and the signal from said accelerated state detecting means.

8. An air/fuel ratio controller for an engine, said controller being equipped with an engine operation zone discriminating means for discriminating a specific operation zone of the engine on the basis of at least one operation parameter of the engine and a lean air/fuel ratio setting means for setting the air/fuel ratio of an air-fuel mixture, which is to be fed to the engine, at a level leaner than a stoichiometric air/fuel ratio upon receipt of an engine operation zone discriminating signal from said engine operation zone discriminating means, which comprises:

an engine power control element;

a means for detecting an acceleration command, which is generated to drive the engine power control element in an engine power increasing direction, on the basis of one of a state of actuation of the engine power control element and a state of actuation of an input side of the engine power control element;

a means for detecting an actually accelerated state of the engine established responsive to the acceleration command;

an air/fuel ratio enriching means operable preferentially to said lean air/fuel ratio setting means so as to set the air/fuel ratio of the air-fuel mixture, which is to be fed to the engine, at a level richer than the air/fuel ratio leaner than the stoichiometric air/fuel ratio; and an air/fuel ratio enrichment control means for setting both starting time and ending time of an operation of said air/fuel ratio enriching means upon receipt of a signal from said acceleration command detecting means and another signal from said accelerated state detecting means, respectively;

said engine being adapted to be mounted on a vehicle;

said acceleration command detecting means having a timer means for generating a signal, which lasts from the starting time point of the acceleration command until the lapse of a predetermined period of time, based on detection results by said acceleration command detecting means, said acceleration command detecting means also comprising a start-up acceleration command detecting means for detecting an acceleration command at the time of starting of the vehicle and an ordinary-time acceleration command detecting means for detecting an acceleration command during ordinary running of the vehicle, and said predetermined period of time being set longer for said start-up acceleration command detecting means than for ordinary time acceleration command detecting means;

said accelerated state detecting means being adapted to continuously generate a signal from the time point of detection of initiation of the actually accelerated state of the engine or an accelerated state right after the initiation of the actually accelerated state until the detection of the termination of the actually accelerated state of the engine or an accelerated state right before the termination of the actually accelerated state when the initiation of the actually accelerated state of the engine or the accelerated state right after the initiation of the actually accelerated state is detected during the generation of the signal from said timer means; and said air/fuel ratio enrichment control means being adapted to cause said air/fuel ratio enriching means to operate continuously during a period in which a logical sum is established between the signal from said acceleration command detecting means and the signal from said accelerated state detecting means.

9. The air/fuel ratio controller as claimed in claim 8, wherein said air/fuel ratio enriching means sets, at the stoichiometric air/fuel ratio, the air/fuel ratio of the air-fuel mixture to be fed to the engine.

10. The air/fuel ratio controller as claimed in claim 8, wherein said start-up acceleration command detecting means detects the acceleration command on the basis of a displacement of the engine power control element or an artificial acceleration control member, which is adapted to drive the engine power control element, from an idling position during an idling operation at the time of standing of the vehicle.

11. The air/fuel ratio controller as claimed in claim 10, further comprising an air/fuel ratio enrichment terminating means for terminating the operation of said air/fuel ratio enriching means preferentially to said air/fuel ratio enrichment control means when a displacement of the artificial acceleration control member or engine power control element in an engine power reducing direction is detected after the signal from said start-up acceleration command detecting means has been generated but before the signal from said accelerated state detecting means is generated.

* * * * *